United States Patent [19]

Nederman

[11] Patent Number: 4,529,146

[45] Date of Patent: Jul. 16, 1985

[54] DEVICE FOR SHIFTING RATCHET MEANS IN WIND-UP APPARATUSES

[76] Inventor: Bill P. P. Nederman, F.M. Franzen Gata 2, S-252 33 Helsingborg, Sweden

[21] Appl. No.: 591,574

[22] Filed: Mar. 20, 1984

[30] Foreign Application Priority Data

Apr. 8, 1983 [SE] Sweden ..... 8301939

[51] Int. Cl.[3] ..... B65H 75/48

[52] U.S. Cl. ..... 242/107.7; 242/106

[58] Field of Search ..... 242/107.7, 107.6, 107.12, 242/99, 106

[56] References Cited

U.S. PATENT DOCUMENTS

| | | | |
|---|---|---|---|
| 794,549 | 7/1905 | Putnam | 242/107.7 |
| 915,997 | 3/1909 | Narum et al. | 242/107.7 |
| 1,520,808 | 12/1924 | Chippindale | 242/107.7 X |
| 1,675,140 | 6/1928 | Schenderlein | 242/107.7 |
| 2,031,459 | 2/1936 | Chambless | 242/107.7 X |
| 2,391,840 | 12/1945 | Meletti | 242/107.7 |

FOREIGN PATENT DOCUMENTS

| | | | |
|---|---|---|---|
| 733511 | 2/1943 | Fed. Rep. of Germany | 242/107.7 |

*Primary Examiner*—John M. Jillions

*Attorney, Agent, or Firm*—Bacon & Thomas

[57] ABSTRACT

This invention relates to a device for shifting ratchet means in wind-up apparatuses which comprise a rotary wind-up drum (1) with one or more pawls adapted to cooperate with the ratchet means (17) to block the rotation of the wind-up drum (1). The wind-up apparatus presents an opening (10) for a means (2) to be wound onto the wind-up drum (1) and is adjustable such that the opening (10) will take a position that permits withdrawal in the desired direction of the means (2) wound onto the wind-up drum (1). To permit shifting the ratchet means (17) by simple means without having to dismantle the wind-up apparatus, the ratchet means (17) has one or more gripping portions (30 and/or 31) which can be caused to cooperate with the wind-up drum (1) to shift the ratchet means (17) in relation to the opening (10) by rotation of the wind-up drum (1).

8 Claims, 11 Drawing Figures

FIG. 7
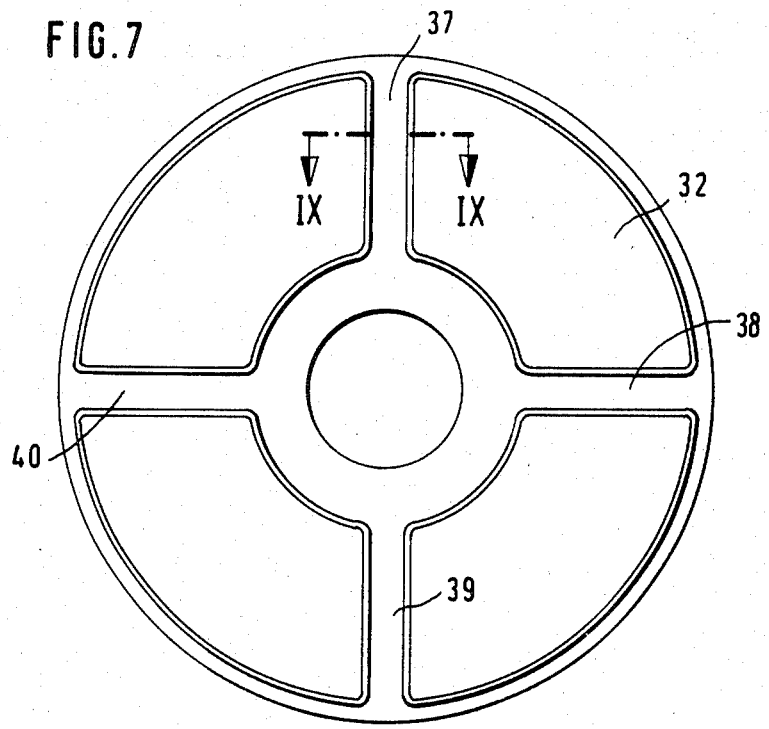
FIG. 8
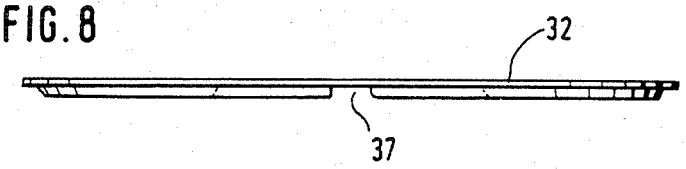
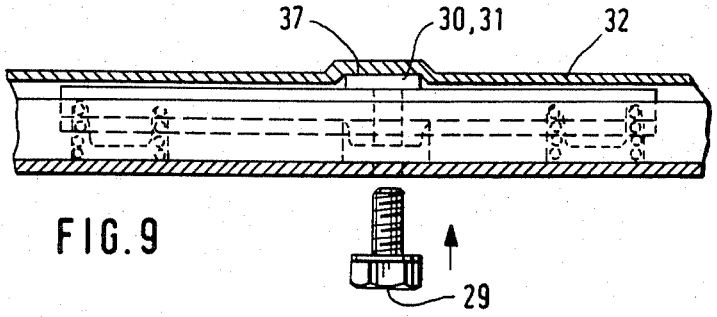
FIG. 9

DEVICE FOR SHIFTING RATCHET MEANS IN WIND-UP APPARATUSES

This invention relates to a device for shifting ratchet means in wind-up apparatuses which have a rotary wind-up drum with one or more pawls adapted to cooperate with the ratchet means to block the rotation of the wind-up drum, said wind-up apparatus presenting an opening for a means to be wound onto the wind-up drum, and being adjustable such that the opening will take a position that permits withdrawal in the desired direction of the means wound onto the wind-up drum.

In wind-up apparatuses such as hose reels in which the hose runs out through an opening at a certain point of the housing of the wind-up apparatus it must be possible to locate the wind-up apparatus in such a position that said opening will be situated at the bottom of the apparatus if it is desired to withdraw the hose downwards, or at another point if it is desired to withdraw the hose in another direction. For a satisfactory blocking function in hose wind-up apparatuses, the ratchet means will have to be located such that the pawl can fall down into it. For maintaining said function, either several ratchet means will have to be placed at suitable points, or one ratchet means must permit being shifted to different points. An embodiment comprising movable ratchet means is preferable, but it is problematical to shift the ratchet means from one point to another since the housing of the wind-up apparatus entirely conceals said ratchet means.

The object of the invention is to eliminate this problem and to provide a simple device for shifting the ratchet means. This and other objects are attained according to the invention substantially in that the device has been given the characteristic features defined by the appended claims.

For further elucidation, the invention will be described more in detail below with reference to the accompanying drawings in which:

FIG. 7 shows a front view of a detail of the wind-up apparatus according to FIG. 1, FIG. 8 shows said detail in a side elevational view;

FIG. 9 shows a section on line IX—IX in FIG. 7, supplemented with certain other details of the device.

Figure 1:
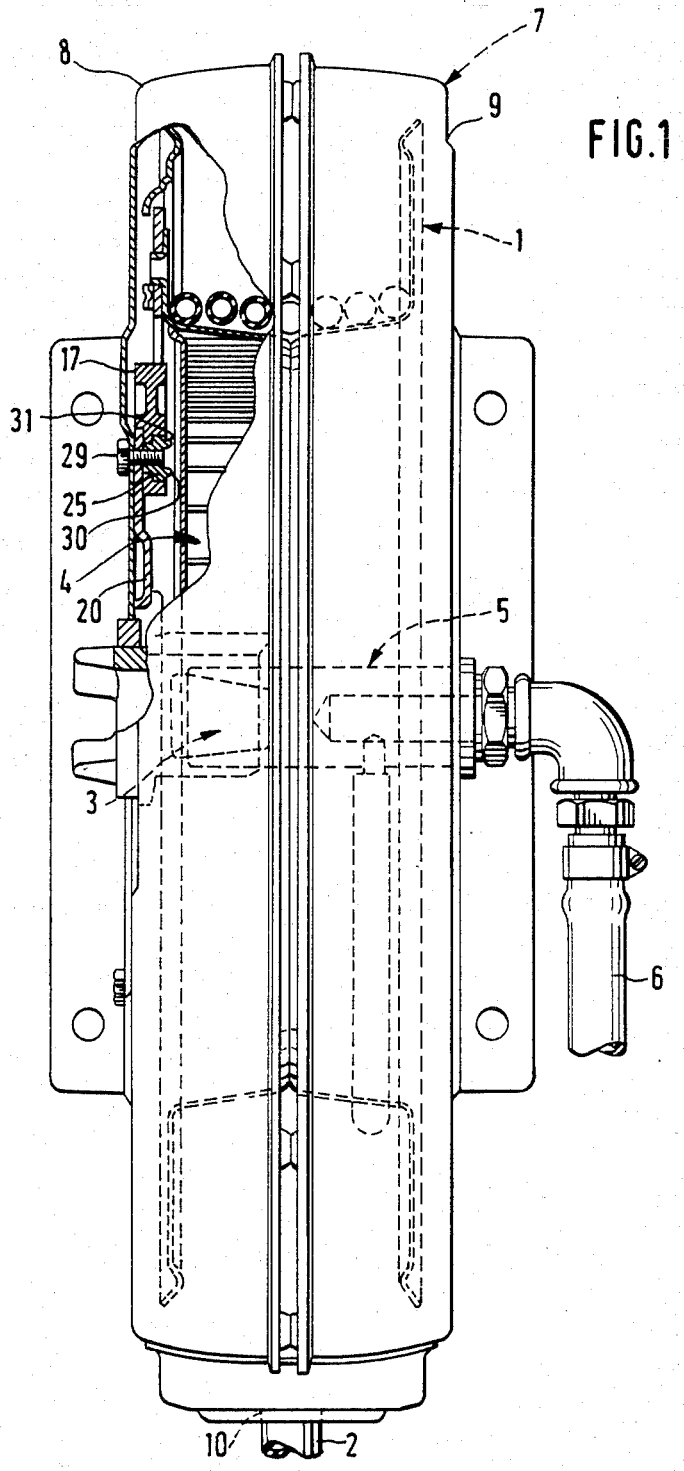
FIG. 1 shows a hose wind-up apparatus equipped with a device according to the invention.
Figure 2:
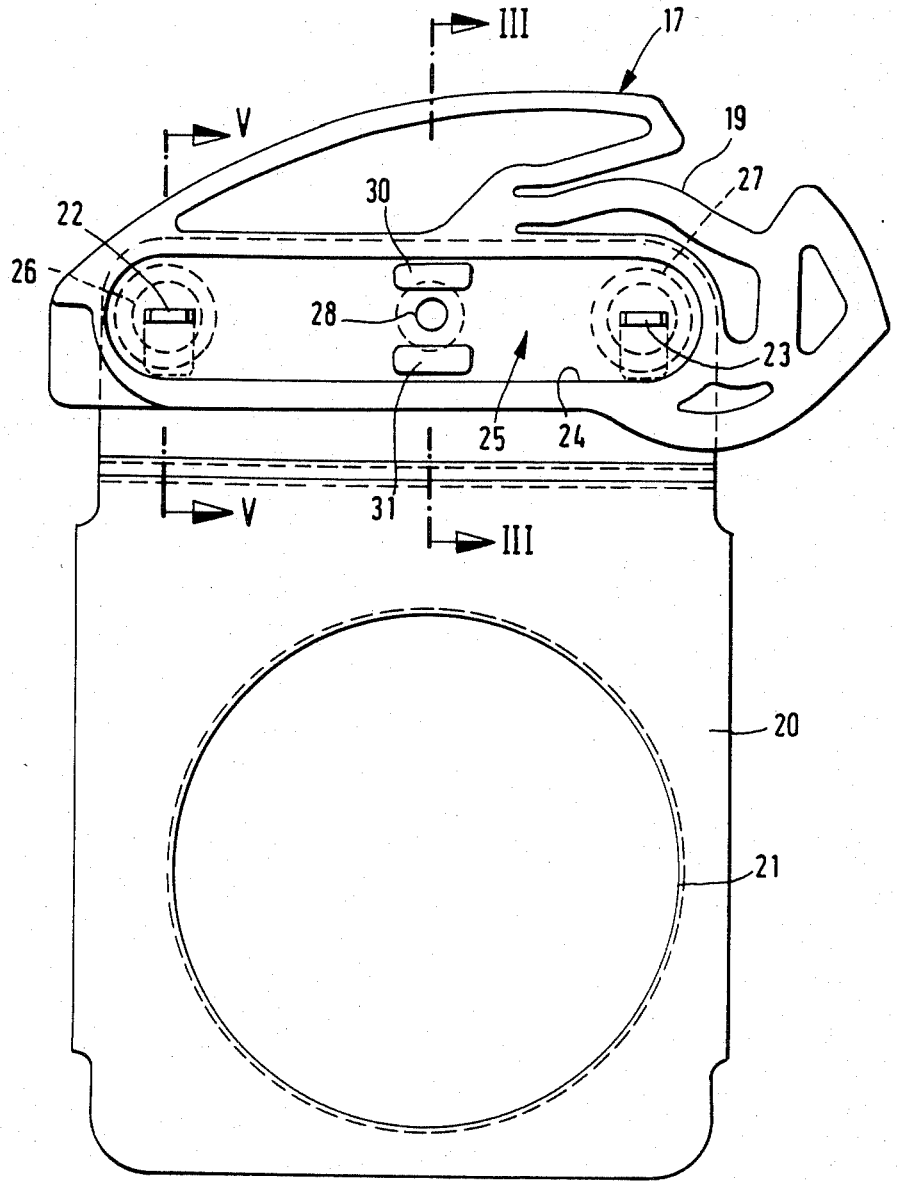
FIG. 2 shows parts of said device in a side elevational view.

The wind-up apparatus illustrated in the drawings comprises a rotatably mounted wind-up drum 1 for reeling in a hose 2. The wind-up drum 1 is rotatably mounted on a shaft 3 and driven so as to reel in the hose 2 with the aid of a spring motor 4 which is tensioned when the hose 2 is withdrawn. The hose 2 to be wound onto the wind-up drum 1 extends to a swivel unit 5 and via said unit 5 the hose 2 is in communication with a hose 6 which extends axially from the swivel unit 5. The wind-up drum 1 is placed in a housing 7 consisting of two screwed-together parts 8, 9. The housing has an opening 10 for the hose 2, and two of the housing sides 11, 12 comprise fastening flanges 13 and 14, respectively, for mounting the wind-up apparatus from a ceiling 15 or on a wall 16 via anchorage fittings 1*a* (see FIGS. 10 or 11).

In order that the wind-up drum 1 shall not reel in the hose but be kept immovable if reeling-in of the hose 2 is not desired, the housing 7 or parts connected thereto have a ratchet means 17 and the drum a pawl 18 cooperating with said ratchet means. This ratchet-and-pawl mechanism functions in such a manner that the pawl engages in a recess 19 of the ratchet means 17 and the wind-up drum 1 is allowed to rotate slowly at the reeling-in of the hose 2, whereby the pawl 18 prevents a further rotation of the wind-up drum 1. If, however, the wind-up drum 1 is allowed to rotate rapidly at the reeling-in of the hose 2, centrifugal force acting upon the pawl 18 results in the pawl 18 not reaching down into the recess 19 of the ratchet means 17. In this case, the wind-up drum 1 will not be stopped at the reeling-in of the hose 2.

To permit shifting a ratchet means 17 mounted beforehand in the wind-up apparatus to various positions (see FIGS. 10 and 11) depending upon the direction in which one wants to withdraw the hose 2, the wind-up apparatus is provided with a special type of device for shifting the ratchet means 17. This device includes an arm 20 with a hole 21 for the shaft 3 of the wind-up drum and with two protruding tongues 22, 23 for the ratchet means 17. Said means 17 is passed onto the tongues 22, 23 and has a space 24 for a gripping means 25. Between parts of the arm 20 and the gripping means 25 coil springs 26, 27 are passed onto the tongues 22, 23. Said coil springs 26, 27 are adapted to urge the gripping means 25 in a direction out of the space 24. The gripping means 25 has a threaded hole 28 for a locking screw 29 and furthermore two gripping portions 30, 31 for cooperation with the wind-up drum 1 or the side face 32 of the spring motor 4. The locking screw 29 is insertable in the housing 7 through one of the four holes (33, 34, 35 or 36) provided therein (see FIGS. 10 or 11).

In order that the gripping portions 30, 31 of the gripping means 25 shall effectively cooperate with the side face 32 of the spring motor 4, said side face 32 is provided with recesses 37, 38, 39 and 40. Each such recess 37, 38, 39 and 40 extends in a radial direction and is of such a depth that the gripping portions 30, 31 can thoroughly engage in said recesses.

Figure 3:
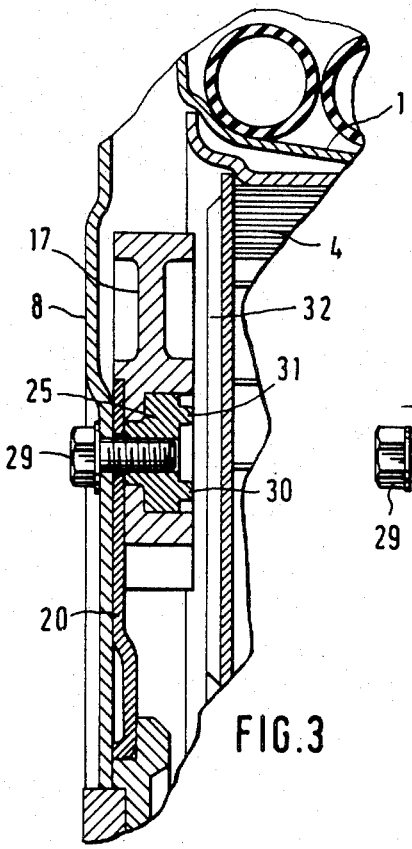
FIG. 3 shows a section on line III—III in FIG. 2.

The gripping means 25 with its gripping portions 30, 31 is adjusted into a position in which it is disengaged from the side face 32 of the spring motor 4, in that the locking screw 29 is screwed into the threaded hole 28 of the gripping means 25. The locking screw 29 thereby pulls the gripping means 25 down into the space 24 against the action of the coil springs 26, 27, and the gripping means 25 is retained in this position (see FIG. 3). The locking screw 29 furthermore holds the arm 20 in position in the housing 7.

Figure 4:
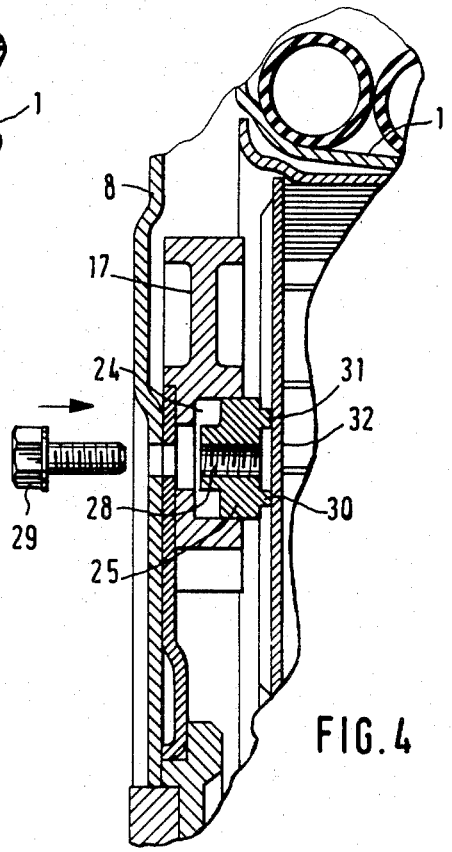
FIG. 4 shows the same section, but with certain parts of the device in other positions.
Figure 5:
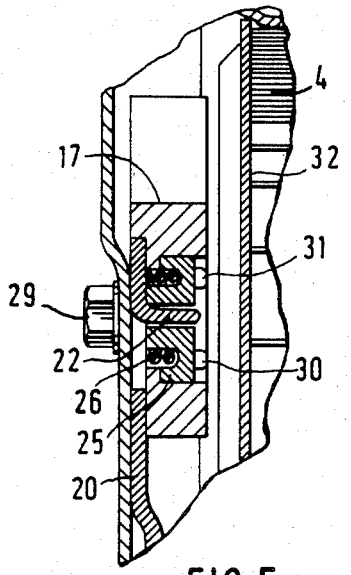
FIG. 5 shows a section on line V—V in FIG. 2.
Figure 6:
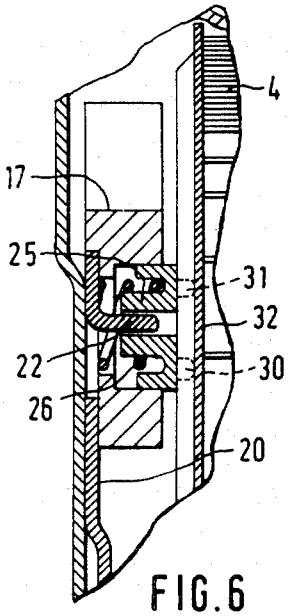
FIG. 6 shows the same section, but with certain parts of the device in other positions.
Figure 10:
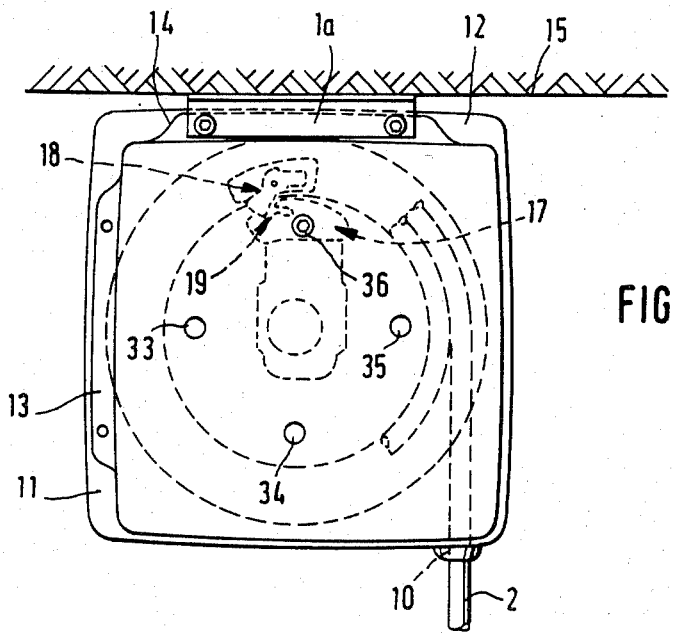
FIGS. 10 and 11 show how the wind-up apparatus can be arranged in different ways depending on the direction in which one wishes to withdraw the hose.
Figure 11:
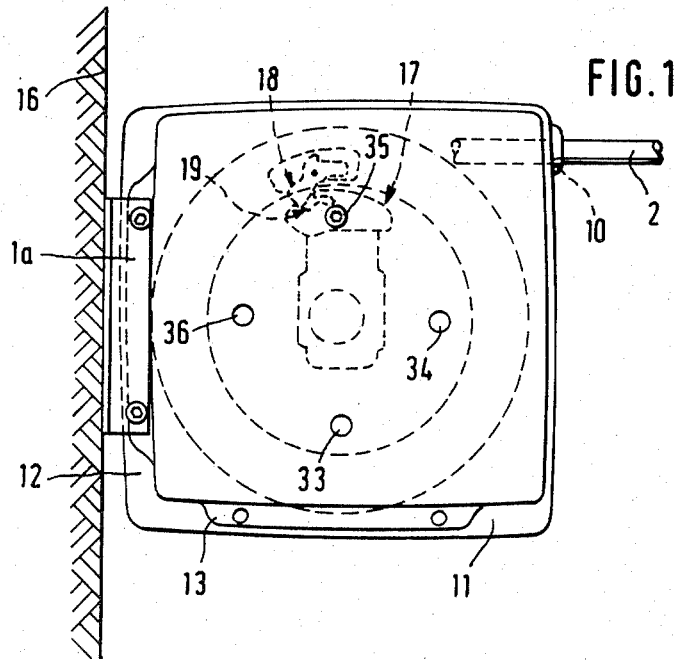

With the ratchet means 17 disposed in the manner shown in FIG. 1, the wind-up apparatus can be mounted from the ceiling with the hose extending in a downward direction (see FIG. 10). When, however, the wind-up apparatus is to be mounted on a wall 16 with the hose extending laterally (see FIG. 11) the ratchet means must be moved to a position at the hole 35. To realize this, the locking screw 29 is screwed out of the threaded hole 28 of the gripping means 25. As soon as the locking screw 29 releases its hold the coil springs 26, 27 urge the gripping means 25 in the direction towards the side face 32 of the spring motor 4 until the gripping portions 30, 31 engage said side face 32 (see FIG. 4). By rotating the wind-up drum 1 one of the recesses 37, 38, 39 or 40 of the side face 32 will register with the gripping portions 30, 31 of the gripping means 25 so that the coil springs 26, 27 can shift the gripping means 25 until its gripping portions 30,31 engage in one of the recesses 37, 38, 39 or 40. By subsequent rotation of the wind-up drum 1 said drum will carry along the ratchet means 17 in that the movement of the wind-up drum 1 is transmitted to the ratchet means 17 via the gripping means 25 and its gripping portions 30, 31. The wind-up drum 1 is rotated until the threaded hole 28 of the gripping means 25 registers with the hole 35 in the housing 7. Then the locking screw 29 is inserted in the hole 35 and screwed into the threaded hole 28 of the gripping means 25, whereby said gripping means 25 is again pulled into the space 24 of the ratchet means 17 until the gripping portions 30, 31 of the gripping means are disengaged from the side face 32 of the spring motor 4. Not only has the ratchet means 17 been caused to occupy the correct position for wall mounting of the wind-up apparatus but also has the side face 32 of the spring motor been released from the gripping means 25 so that the wind-up apparatus can freely rotate again.

The hose wind-up apparatus illustrated in the drawings has been chosen for elucidatory rather than restrictive purposes. The invention can of course be applied to other kinds of wind-up apparatuses than hose reels. The design of the wind-up apparatus and that of the device according to the invention can vary. Thus, the housing of the wind-up apparatus may be provided with fastening flanges on three sides or on all four sides instead of on two sides. There may be more than one ratchet means 17 and more than one pawl 18. Moreover, recesses for the gripping portions may be arranged in the side face of the drum instead of in the side face of the spring motor, and the recesses may instead be in the form of grooves. Also, their number may vary, as is deemed suitable. The locking screw 29 may be replaced by some other type of locking means, and the gripping means and the ratchet means may vary in respect of design.

I claim:

1. A device for shifting a ratchet means associated with a wind-up apparatus of the type including a rotary drum having at least one pawl for cooperative engagement with the ratchet means to block the rotation of the drum and an opening which may be positioned in the direction of withdrawal of an article wound on the drum, the device comprising:

(a) the drum including a side face;

(b) the ratchet means including gripping means engageable against the side face of the drum;

(c) means for placing the gripping means into and out of engagement with the side face of the drum to permit shifting of the ratchet means upon rotation of the drum; and (d) means carried by the side face of the drum for selective engagement by the gripping means during shifting of the ratchet means to align the ratchet means relative to the position of the opening.

2. The device of claim 1 wherein the means for placing the gripping means into and out of engagement with the side face of the drum includes:

(a) at least one gripping portion movable towards and away from the side face of the drum;

(b) means for biasing the gripping portion towards the side face of the drum; and (c) releasable locking means for securing the gripping portion away from the side face of the drum.

3. The device of claim 2 wherein the gripping means includes a pair of spaced gripping portions and the means for biasing the gripping portions towards the side face of the drum includes at least one coil spring.

4. The device of claim 3 wherein the gripping portions are supported for movement on at least one tongue carried by the ratchet means and the coil spring surrounds the tongue.

5. The device of claim 2 wherein the means for releasably securing the gripping means includes a threaded bolt and a correspondingly threaded socket formed in the gripping means.

6. The device of claim 5 wherein the device is enclosed within a housing and the housing is provided with a plurality of spaced holes through which the threaded bolt may be selectively received.

7. The device of claim 1 wherein the side face of the drum is substantially circular in configuration and the means thereon for selective engagement by the gripping means includes a plurality of radially extending recesses.

8. The device of claim 1 wherein the drum is supported on a shaft and the ratchet means is carried on an arm which is mounted for rotation about the shaft.

* * * * *